United States Patent [19]

Hunter

[11] 4,319,666

[45] Mar. 16, 1982

[54] VEHICLE SERVICE JACK

[76] Inventor: Lee Hunter, 13501 Ladue Rd., Creve Coeur, Mo. 63141

[21] Appl. No.: 89,163

[22] Filed: Oct. 29, 1979

[51] Int. Cl.[3] ..... B66B 1/00

[52] U.S. Cl. ..... 187/43; 187/5; 254/89 H

[58] Field of Search ..... 187/8.41, 8.43, 8.49, 187/8.5, 8.71, 8.72; 254/89 H

[56] References Cited

U.S. PATENT DOCUMENTS

| | | | |
|---|---|---|---|
| 2,201,147 | 5/1940 | Barg et al. | 187/8.72 |
| 2,240,756 | 5/1941 | Bristol | 254/89 |
| 2,790,683 | 4/1957 | Clark | 187/8.72 |
| 2,849,084 | 8/1958 | Hott et al. | 187/8.5 |
| 3,317,004 | 5/1967 | Harrison, Jr. | 187/8.72 |
| 3,563,345 | 2/1971 | MacMillan | 187/8.43 |
| 3,789,958 | 2/1974 | Masaitis | 187/8.49 |
| 4,050,545 | 9/1977 | Hunter | 187/8.43 |

FOREIGN PATENT DOCUMENTS

| | | | |
|---|---|---|---|
| 2007429 | 9/1971 | Fed. Rep. of Germany | 187/8.72 |

*Primary Examiner*—David A. Scherbel
*Assistant Examiner*—Kenneth Noland
*Attorney, Agent, or Firm*—Gravely, Lieder & Woodruff

[57] ABSTRACT

A service jack to be mounted on a vehicle lift rack for movement into desired places along the runways of the lift rack. The service jack includes a carriage suspended between the runways, an elongated vehicle lifting jack assembly operably supported by the carriage for vertical movement toward and away from the frame members of a vehicle supported on the runways, a fluid pressure lifting member between the carriage and the vehicle lifting jack assembly, releasible safety device responsive to raising of the vehicle lifting jack assembly for preventing accidental reverse movement thereof, and devices for guiding and maintaining the vehicle lifting jack assembly in a substantially level attitude in all positions.

5 Claims, 6 Drawing Figures

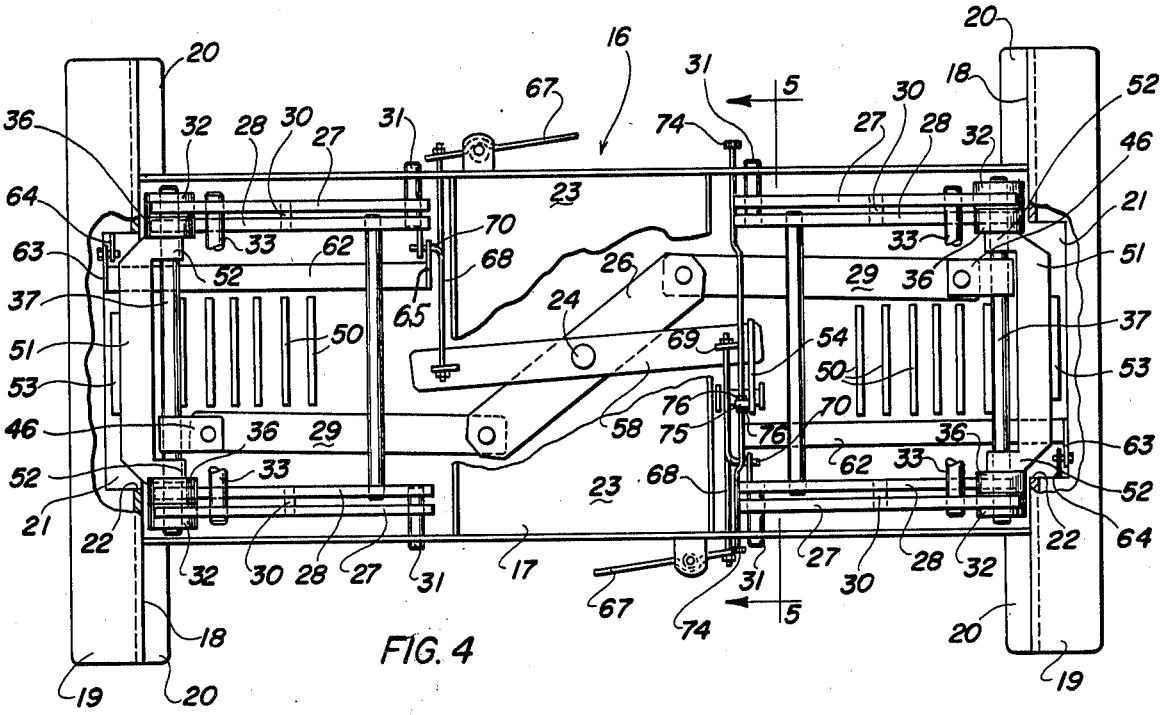
FIG. 4
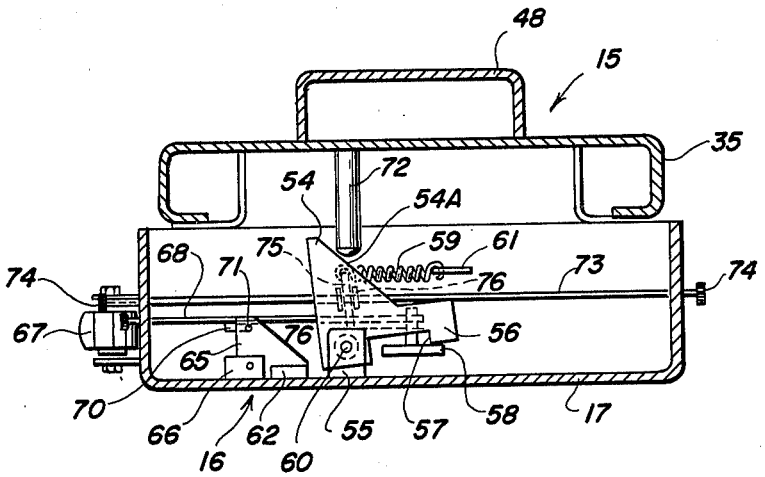
FIG. 5
FIG. 6
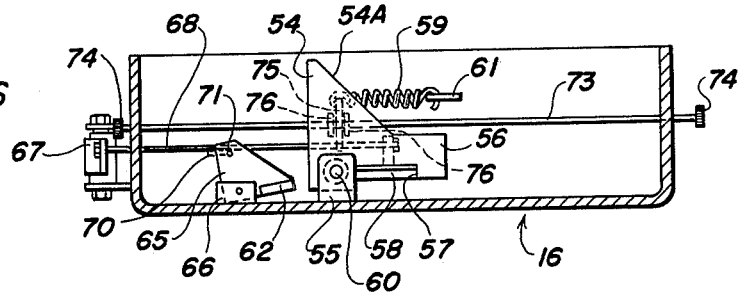

VEHICLE SERVICE JACK

BACKGROUND OF THE INVENTION

The servicing of vehicles is not limited to the routine lubrication needs, but includes periodic examination and adjustment in the alignment of the wheels. Normally the alignment of wheels may be examined most easily when the vehicle is raised to a convenient elevation. The raising is accomplished by placing the vehicle on a runway structure which then bodily raises the same. However, the wheels must support the vehicle at this time, and subsequently the wheels need to be elevated above the runway. A number of devices have been provided for accomplishing the latter function.

For example, an early device is disclosed in the Bristol U.S. Pat. No. 2,240,756 issued May 6, 1941. Here a jack carried by a runway hoist assembly is applied to the vehicle frame for vibrating the frame during the lubricating of the wheel and frame joints. It is also known from the MacMillan U.S. Pat. No. 3,563,345 issued Feb. 16, 1971, and from Masaitis U.S. Pat. No. 3,789,958, issued Feb. 5, 1974, that a twin-air cylinder lifting device carried by the elevated wheel runways could be used to raise the wheel for alignment servicing purposes. An improved twin-cylinder jack assembly is disclosed in Hunter U.S. Pat. No. 4,050,545 issued Sept. 27, 1977 in which safety ratchet and pawl means are used to prevent accidental dropping of the vehicle during wheel alignment servicing. A common characteristic of the foregoing patented devices was the arrangement whereby the devices could be folded into positions presenting a minimum dimension upon lowering the runways to the floor when receiving and discharging a vehicle.

The problem with the devices referred to above is that the folding characteristics requires certain extra structure and that increases the cost of production and subsequent maintenance during the useful life of the assembly. Furthermore, a foldable device must be prevented from returning to its folded position after being moved into the operative position and operated to raise a vehicle.

BRIEF DESCRIPTION OF THE INVENTION

This invention relates to improvements in vehicle service equipment, and particularly to jack assemblies for use with vehicle service racks.

The objects of this invention are to provide a simple service jack to be used with a lift rack for positioning vehicles for performing services thereon, to provide an inexpensive and trouble-free service jack which may be adapted to a variety of vehicle sizes and frame constructions, and to provide a service jack which may be positioned as desired along the lift rack on which it is mounted so as to reach the front or rear suspension for facilitating servicing operations.

A preferred embodiment of the present invention includes a lifting jack assembly carried by a vehicle service rack for elevating the vehicle relative to the service rack runways, and in which there is provided a carrier attached to the runway to span the distance therebetween, a jacking member operatively carried by the carrier, means between the carrier and the jacking member for elevating the jacking member into vehicle lifting engagement, safety means between the jacking assembly and the carrier for preventing accidental reverse movement or fall of the jacking member when in engagement with a vehicle, and means for permitting lowering of the jacking member at the conclusion of service operations.

The preferred embodiment as arranged with an organization of mechanical means for effecting the guidance and safety control of the jacking assembly relative to the carrier, whereby the jacking assembly is safeguarded so as to avoid the possibility of injury to service personnel.

BRIEF DESCRIPTION OF THE DRAWINGS

The preferred embodiment of the present vehicle service jack is illustrated in the accompanying drawings, wherein:

FIG. 4 is a plan view of the operating mechanism of the jack taken along line 4—4 in FIG. 2;

FIG. 5 is a sectional view taken along line 5—5 in FIG. 4 to show certain operating components; and FIG. 6 is a further fragmentary view of the operating components of FIG. 5, but in a different position.

DETAILED DESCRIPTION OF THE EMBODIMENT

Figure 1:
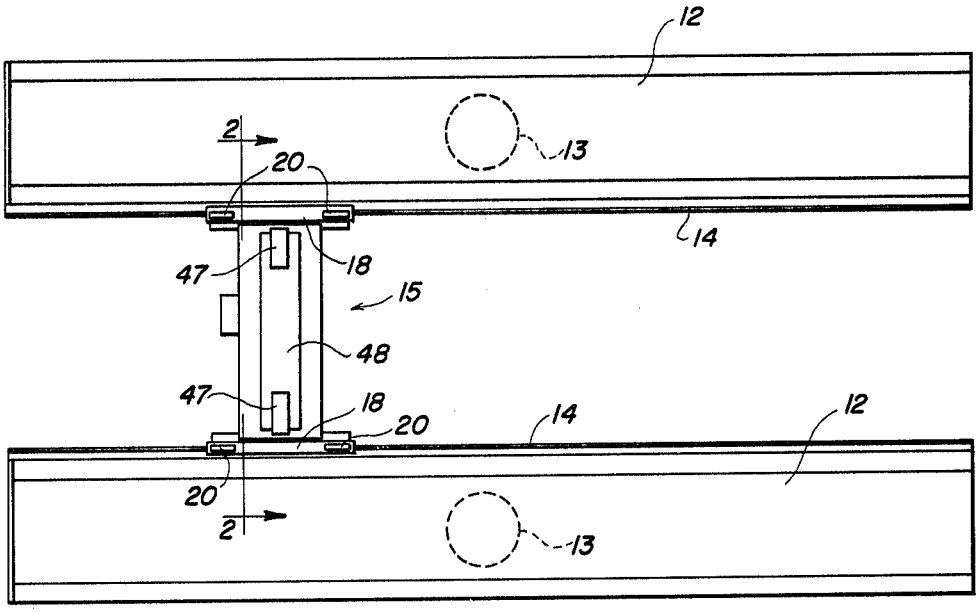
FIG. 1 is a plan view of a vehicle lift rack and the presently preferred embodiment of the service jack carried by the runways of the vehicle lift rack.

The structure shown in the drawings includes a vehicle hoist having a pair of runways 12 movable in a vertical path by coordinated pistons 13 which will allow the runways 12 to have a home position adjacent the floor of the service area and a selective raised position such that service personnel may easily have access to the frame and suspension system of a vehicle. Each of the runways 12 is provided with a rail member 14 along the inside margin which runs substantially the length of the runways for a purpose to appear presently.

Figure 2:
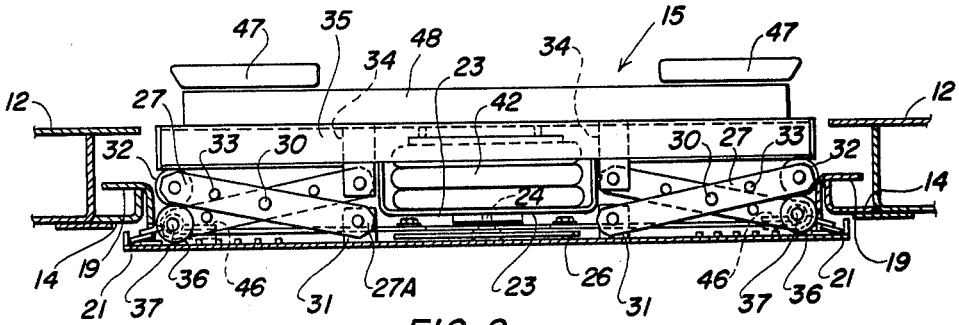
FIG. 2 is a view taken along line 2—2 in FIG. 1 showing the service jack in retracted position.

In the view of FIGS. 1, 2 and 5, the jack assembly 15 comprises a carrier 16 formed by an upwardly opening channel 17 directed between the runway rail members 14. The respective ends of the carrier channel 17 are closed by support members 18 having outturned flanges 19 which extend over the rail members 19. Suitable roller assemblies 20 are mounted on the support members 18 to facilitate the placement of the unloaded jack assembly 15 at selected positions along the runways. After the assembly 15 is placed on the tracks 14 at the desired location and the weight of the vehicle is picked up, the roller assemblies 20 allow the flanges 19 to rest on the tracks 14. A lip portion 21 of the bottom surface of the channel 17 at each end is extended through a notch 22 (FIG. 4) in the vertical portion of each support members.

The channel 17 is provided with a transversely directed and centrally positioned upwardly opening channel base 23 (FIG. 3) which is spaced above the bottom surface of the channel 17. A pivot element 24 extends between the base 23 and the bottom 17 of the channel. The pivot element 24 supports a first lever 26 to be operatively associated with scissor type and pivotally interconnected stabilizer links 27 and 28. The lever 26 is connected at one end by a link 29 to links 28 at one side of the base 23, and its opposite end is connected by a similar link 29 to another one of the links 28 at the other side of the base 23. The lever 26 operates through the respective links 29 to coordinate and force the pivotally associated links 27 and 28 to operate in unison. The links 27 and 28 at each side of the base 23 are arranged in duplicates connected by pivots 30. Thus, there are duplicate scissor links 27 and 28 at each side of the base 23, and these scissor links are widely spaced to perform the stabilizing function to be described presently.

Figure 3:
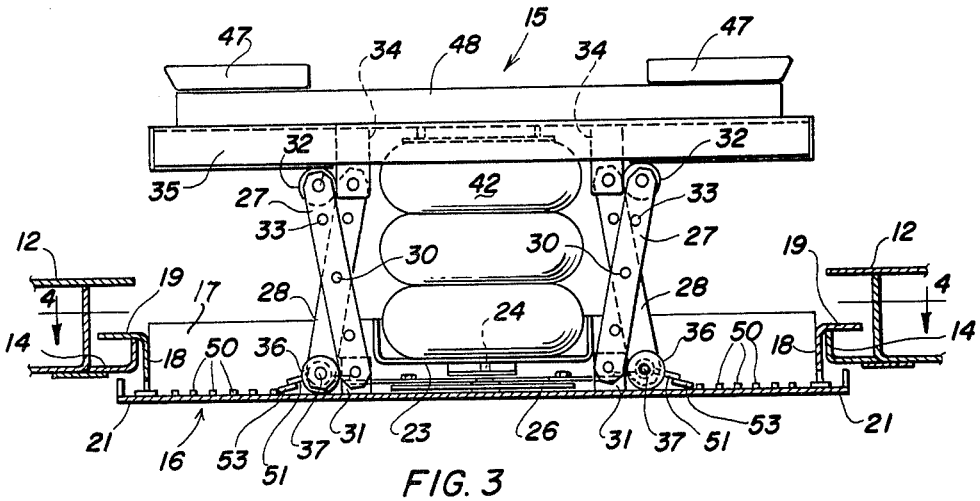
FIG. 3 is a view of the service jack extended to reveal some of the operating mechanism, the view being similar to FIG. 2.

Turning now to FIGS. 2, 3 and 4, it can be seen that a pair of pivot elements 31 are located in axial alignment at each side of the base 23. These pivots secure the bottom ends of the links 27, the opposite ends of these links 27 are provided with rollers 32, and the links are interconnected by a rod 33 to retain them in alignment. The cooperating links 28 are pivotally connected by bracket elements 34 to a frame member or vehicle lifting means 35 of the jack 15. The lower ends of the links 28 are provided with rollers 36, and the adjacent ends are interconnected by a rod 37 to keep them in proper alignment.

The foregoing scissor stabilizer links 27 and 28 are disposed on opposite sides of an extendible-collapsible air lift device 42. The device 42 is anchored to the base 23 (FIG. 3) and a suitable pressure fluid conduit may be attached and runs through a control value to a source of pressure fluid (not necessary to show). The upper end of the device 42 is attached to the member 35 (FIG. 3). Thus, as the device 42 elevates or lowers the member 35, the scissor stabilizer links 27 and 28 move between erect folded positions (FIG. 3) with the rollers 32 and 36 widely spaced, and collapsed folded positions (FIG. 2) with the rollers 32 and 36 in closely adjacent positions near the support members 18. The rods 37 in the links 28 carry a connective part 46 which is connected to the adjacent ends of the link 29. The connection of the link 29 to the respective links 28 by parts 46 cause these links to move in unison, thereby forcing the member 35 to remain substantially level throughout its vertical rise or fall. It is noted that the scissor links follow the action of the lift device 42, and the action of the links 27 and 28 on one side is duplicated by the links 27 and 28 on the opposite side by the interconnected lever 26 and links 29.

The member or vehicle lifting means 35 in the jack assembly carries a pair of frame engaging shoes 47 slidably mounted in a guide 48. The shoes can be adjustably moved axially of the guide 48 to suitable positions under the frame and/or wheel suspension mechanism for elevating the vehicle off the runways 12.

There is shown in FIGS. 3 and 4, safety means which is operatively associated with the motion stabilizing means represented by links 27 and 28. The floor surface of the channel 17 of the carrier 16 is provided with a plurality of fixed ratchet teeth 50 which have been welded into place in a predetermined fixed spacing. The teeth are elongated, being formed of suitable bar stock. There is a set of ratchet teeth 50 at respective opposite ends of the floor surface, and they are aligned with the notches 22 formed in the support members 18. When the respective stabilizing links 27 and 28 are in the retracted folded position as seen in FIG. 2, the rods 37 in links 28 move outwardly toward the opposite ends of the carrier 16 so as to be directly over the ratchet teeth 50. Each of these rods 37 furnishes a suitable means for attaching a pawl plate 51 which is pivotally attached to the bar 37 at the respective bearing elements 52 which are in widely spaced relation. Each pawl plate carries a hardened lip 53 which is in position as the pawl plate is drawn inwardly over the ratchet teeth 50 to serially pass over and drop in between the spaces between the teeth 50. The pawl plate 51 and lip 53 is of a sufficient size to have significant weight so that as the scissor links 37 and 38 follow the elevation of the jack member 15 the lip 53 will bounce over the ratchet teeth 50 making a familiar clicking sound which is associated with the operation of a ratchet and pawl device.

The motion of the rod 37 is substantially linear in its movement inwardly from the outer end of the carrier 16, and this affords a suitable place to attach the end of the link 29 through a suitable connective part 46 which is free to pivot on the bar 37 while being connected to the end of the link 29. The inner end of the link 29 is connected to a lever 26 which transfers the motion of the links 28 at one end of the carrier 16 to the identical links 28 at the opposite end of the carrier 16. Since these parts are duplicates they are referred to by the same reference numerals. Thus, each of the pawl plates 51 is drawn over the ratchet teeth 50 as the lifting device 42 elevates the jack assembly 15. Concurrently, the pawl plates and hardened lips 53 pass over the ratchet teeth 50 so that should there be a failure of pressure fluid supply to the lifting device 42 the pawl plates 51 would engage the ratchet teeth 50 and prevent reverse movement or fall of the jack assembly 15.

FIGS. 4, 5 and 6 disclose safety means associated with the ratchet and pawl devices so as to ensure the prevention of accidents in the event of loss of pressure fluid while service personnel are beneath the vehicle supported on the jack assembly 15. The safety means includes a latch plate 54 pivotally supported in the carrier 16 on a suitable bracket 55 such that a plate extension 56 formed with a notch or a cut out 57 is in position to overlie one end of a pivoted lever 58 which is pivoted centrally of its length on the pivot element 24. As will appear presently the lever 58 is held in a set position FIG. 6 when the notch 57 drops down over the adjacent end. The notch 57 in the plate extension 56 is forced down over the adjacent end of the lever 58 by resilient means 59, one end being attached to the latch plate above its pivot 60 and the other end of the resilient means being attached at bracket 61 to the adjacent side of the base channel 23.

It can be seen in FIGS. 4, 5 and 6 that there are pawl lifter means 62 lying adjacent each series of ratchet teeth 50, each lifter means being pivotally connected by an end bracket 63 to a fixed bearing support 64, secured in the carrier 16. The inner end of each of the pawl lifter means 61 is provided with an enlarged end bracket 65 which is pivotally connected to a bracket 66 fixed in the carrier 16. The pivotal connection at the end brackets 64 and 66 lie in a common axis so that the lifter means 62 can be pivoted upwardly around the axis away from the floor surface of the carrier 16. It is noticed that each of the lifter means 62 extends along side the position of the ratchet teeth 50 so as to be in the path of movement of the pawl plates 51 over these teeth. Therefore, when the lifter means 62 is pivoted so as to raise it upwardly (FIG. 6) from the carrier surface it will elevate the pawl plates 51 simultaneously because the lifting of one means 62 will be transferred by lever 58 to the opposite lifter for elevating the associated pawl plate 51.

The means for actuating the lifter means 62 includes a manually operated lever 67 positioned on the side of the carrier 16, and a duplicate lever 67 is positioned on the opposite side viewed in FIG. 4. Actuating rod 68 has one end projected through the wall of the carrier 16 so as to be engaged by the lever 67, while the opposite end of the rod 68 is engaged in a bracket 69 carried by the lever 58. The rod 68 carries a connective finger 70 in position to engage in an aperture 71 in the end bracket 65 fastened to the lifter means 62. It is noticed that the aperture 71 is located above the pivot axis for the lifter means 62, thereby pivoting the rifter means 62 upwardly (counter clockwise) when the lever 67 is actuated in a direction to pull outwardly on the rod 68. Simultaneously on pulling on the rod 68 the lever 58 will through its connection at the opposite end to a duplicate rod 68 push the duplicate rod 67 in an outward direction to force the connective finger 70 fastened thereto to pivot or lift the opposite associated lifter means 62. In this manner both the pawl lifter means 62 will be operated in unison to raise the respective pawl plates 51 for disabling the ratchet and pawl devices, whereby release of pressure fluid from the lifting device 42 will permit the weight of the vehicle on the jack member 35 to collapse the jack assembly and return it to its retracted position.

In the arrangement of the foregoing safety means, the weight of the pair of pawl means 51 and the lips 53 thereon is such that these parts will always tend to force the pawl lifter means 62 down adjacent the surface of the carrier 16 so that as the pawl plates 51 are moved across the ratchet teeth 50 the lips 53 will properly engage the successive ratchet teeth 50. In order to overcome the weight tendency of the pawl plates 51 to push the pawl lifter means down, it is necessary to provide the latch plate 54 with a notch 57 to engage the opposite ends of the lever 58, and to resiliently retain the notch 57 over the lever 58 so that the pawl lifter means 62 will be retained in the elevated position (FIG. 6), thereby allowing the jack assembly to be lowered.

It is noticed that the latch plate 54 is formed with an angular margin 54A for the purpose of being in the path of a descending reset pin 72 (FIG. 5) secured in the jack assembly 15 in alignment with the angular margin 54A. The reset pin 72 has a sufficient length so that as the jack member 35 closes to its fully down position relative to the carrier 16 it will engage the margin 54A and pivot the latch plate 54 so that the notch 57 is raised to release the lever 58. As pointed out above, the release of the lever 58 from the notch 57 will allow the pawl plates 51 to pull the lifter means 62 down and thereby restore the desired safety function performed for the ratchet teeth 50 and the pawl plates 51. Thus, the reset pins 72 automatically conditions or resets the ratchet and pawl means for effective operation at the next raising of the jack assembly 15.

If it is necessary or desirable to actuate the latch plate 54 to release the notch 57 from the end of lever 58, the operator can do so by means of the pull-push rod 73 which projects through the end walls (FIGS. 5 and 6) of the carrier where knobs 74 can be grasped. The rod 73 extends through an aperture in a bracket 75 fixed on the plate 54, and keeper elements 76 are carried by the rod at each side of the bracket 75. The keepers cause motion of rod 73, in either direction, to move the plate 54. Actuation of the plate 54 by means of the pull-push rod 73 will allow the pawl plates 51 to become effective to engage the ratchet teeth 50. This means 73 performs the same function as the reset pin 72, but while the apparatus is in extended position, as in FIG. 3, or some intermediate lower position.

What is claimed is:

1. In a vehicle service rack having spaced apart vehicle wheel supporting runways for supporting the vehicle above a service floor, the improvement in the service rack of a vehicle lifting jack assembly carried by the service rack comprising: a carrier spanning the space between the runways and operatively supported thereon for movement along the service rack; vehicle lifting means parallel with and overlying said carrier; duplicate linkage means operatively extending from said carrier to said lifting means at positions spaced inwardly from each end of said lifting means and carrier, said linkage means acting to stabilize and maintain said lifting means substantially parallel with said carrier; elevating means operatively positioned on said carrier and beneath said lifting means for raising and lowering said lifting means relative to said carrier; coordinating means connected between said duplicate linkage means for effecting simultaneous operation of said linkage means in response to said elevating means raising and lowering said lifting means; and safety means operatively associated with said duplicate linkage means, said safety means including first means automatically operable upon raising of said lifting means to prevent lowering of said lifting means, and second means manually operable to disable said first automatically operable means for permitting the lowering of said lifting means.

2. The improvement set forth in claim 1, wherein said duplicate linkage means each comprises scissor links having first ends pivotally anchored at said carrier and at said lifting means and second ends movable along said carrier and said lifting means, and said coordinating means interconnecting one of second ends of said scissor links in each of said duplicate linkage means.

3. The improvement set forth in claim 1, wherein said duplicate linkage means each comprises scissor links having first ends pivotally anchored at said carrier and at said lifting means and second ends movable along said carrier and said lifting means in directions along the lengths thereof between said runways; and said safety means includes pawl elements carried by certain of said second ends and fixed elements carried by said carrier in spaced array to be engaged by said pawl elements during vehicle lifting operation to prevent lowering of said lifting means.

4. In a vehicle service rack having spaced apart vehicle wheel supporting runways for supporting a vehicle above a service floor, the improvement of a lifting assembly for lifting the vehicle relative to the runways, said lifting assembly comprising: a carrier supported on and extending between the spaced runways; vehicle lifting means extending between the spaced runways in substantially parallel relation to said carrier; elevating and lowering means between said carrier and vehicle lifting means for elevating said lifting means from a retracted position adjacent said carrier to a position against the vehicle to raise the vehicle off the runways; duplicate motion stabilizer means arranged on each side of said elevating and lowering means and each including sets of scissor links with certain ends pivoted to said carrier and to said lifting means, and certain other ends movable relative to said carrier and to said lifting means during operation of said elevating and lowering means; motion transfer means operatively connected to said sets of scissor links of said motion stabilizer means for maintaining substantially level motion in the vehicle raising operation of said elevating and lowering means; ratchet means carried by said carrier in a linear array on each side of said lifting and lowering means so as to be adjacent the path of movement of said certain other ends of said scissor links in each of said duplicate motion stabilizing means, each of said linear arrays of ratchet means being fixed relative to said carrier and said lifting means; pawl means operated by and following the motion of said certain other ends of said scissor links in each of said duplicate motion stabilizing means; said pawl means being in position to travel over said adjacent array of ratchet means and engage the same during vehicle raising operation for preventing reverse movement of the vehicle; manually operable means in said lifting means for disabling said pawl means from engaging said arrays of ratchet means whereby said lifting means is able to reverse for returning the vehicle to the runways; and other means on said lifting means for automatically cancelling said disabling of said pawl means by said manually operable means upon return to the carrier.

5. The improvement set forth in claim 4, wherein said carrier is formed with opposite end walls extending between said runways, said manually operable means in said lifting means includes rod means extending through each of said end walls, said lifting assembly is movable along the runways to selected positions beneath the vehicle; and said disabling means is accessible from either front or rear of the vehicle through said rod means of said manually operable means.

* * * * *